US010595655B2

(12) United States Patent
Hernandez et al.

(10) Patent No.: US 10,595,655 B2
(45) Date of Patent: Mar. 24, 2020

(54) MULTI-HOOK HANGERS FOR STEAMING FABRICS

(71) Applicant: HOME PRODUCTS INTERNATIONAL-NORTH AMERICA, INC., Chicago, IL (US)

(72) Inventors: Rolando Hernandez, Oak Lawn, IL (US); Gabriel Prero, Chicago, IL (US)

(73) Assignee: Home Products International-North America, Inc., Chicago, IL (US)

( * ) Notice: Subject to any disclaimer, the term of this patent is extended or adjusted under 35 U.S.C. 154(b) by 117 days.

(21) Appl. No.: 15/918,299

(22) Filed: Mar. 12, 2018

(65) Prior Publication Data

US 2018/0263397 A1 Sep. 20, 2018

Related U.S. Application Data

(60) Provisional application No. 62/473,009, filed on Mar. 17, 2017.

(51) Int. Cl.

| | |
|---|---|
| ***A47G 25/30*** | (2006.01) |
| ***A47G 25/32*** | (2006.01) |
| ***A47G 25/34*** | (2006.01) |
| ***A47G 25/48*** | (2006.01) |

(52) U.S. Cl.
CPC ..... *A47G 25/30* (2013.01); *A47G 25/32* (2013.01); *A47G 25/34* (2013.01); *A47G 25/483* (2013.01); *A47G 25/487* (2013.01)

(58) Field of Classification Search
CPC ..... A47G 25/00; A47G 25/70; A47G 25/483; A47G 25/487
See application file for complete search history.

(56) References Cited

U.S. PATENT DOCUMENTS

| | | | | | |
|---|---|---|---|---|---|
| 1,393,843 | A | * | 10/1921 | Smith | A47G 25/06 211/32 |
| 1,749,871 | A | * | 3/1930 | Bliss | A47G 25/54 312/4 |
| 2,494,973 | A | * | 1/1950 | Vollmer | A47G 25/18 223/88 |
| 2,605,906 | A | * | 8/1952 | Pontius | A47G 25/08 211/106 |

(Continued)

FOREIGN PATENT DOCUMENTS

WO WO 2010/118459 * 10/2010

*Primary Examiner* — Ismael Izaguirre

(74) *Attorney, Agent, or Firm* — Neal, Gerber & Eisenberg LLP

(57) ABSTRACT

Apparatus are disclosed for multi-hook hangers for steaming fabrics. An example hanger includes hooks that include rod hooks for hanging from a rod. The rod hooks include a first rod hook and a second rod hook that are spaced apart from and parallel to each other. The hooks also include a back hook for hanging from a wall hook. The back hook is coupled to the first rod hook and the second rod hook. The example hanger also includes arms including a first arm and a second arm. Each of the arms include a back arm segment, a front arm segment spaced apart from the back arm segment, and a curved end extending between and connecting the front arm segment and the back arm segment. The example hanger also includes a base connecting the hooks to respective arms.

19 Claims, 5 Drawing Sheets

(56) References Cited

U.S. PATENT DOCUMENTS

| | | | | |
|---|---|---|---|---|
| 2,633,246 | A * | 3/1953 | Guthrle | A47G 25/10<br>211/32 |
| 2,699,263 | A * | 1/1955 | Ore | A47G 25/1457<br>211/113 |
| 2012/0097717 | A1 * | 4/2012 | Viehe | A47B 61/003<br>223/88 |

* cited by examiner

MULTI-HOOK HANGERS FOR STEAMING FABRICS

CROSS-REFERENCE TO RELATED APPLICATION

This application claims the benefit of U.S. Provisional Application No. 62/473,009, which was filed on Mar. 17, 2017, which is incorporated by reference herein in its entirety.

TECHNICAL FIELD

The present disclosure generally relates to hangers and, more specifically, to multi-hook hangers for steaming fabrics.

BACKGROUND

Typically, steamers (e.g., clothes steamers, garment steamers) are utilized to steam garments and/or other fabrics. Oftentimes, a user utilizes a steamer to remove and/or reduce wrinkles of a garment without ironing the garment. Steamers remove and/or reduce wrinkles of a garment by emitting high temperature steam onto and/or through the garment that relaxes fibers of the garment. For example, a steamer may be utilized to remove wrinkles from delicate fabrics (e.g., silk) without scorching the delicate fabrics. Oftentimes, a garment and/or other fabric is hung from a hanger to enable user to steam the garment and/or other fabric via a steamer.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for multi-hook hangers for steaming fabrics. An example disclosed hanger includes rod hooks configured to hang from a rod. The rod hooks include a first rod hook and a second rod hook that are spaced apart from and parallel to each other. The example disclosed hanger also includes a back hook configured to hang from a wall hook. The back hook is coupled to the first rod hook and the second rod hook. The example disclosed hanger also includes arms configured to hang a garment and a base that connects the arms to the rod hooks and provides structural support to the arms.

In some examples, the rod hooks define a first aperture for receiving the rod. In some such examples, a central axis of the first aperture extends in a direction that is substantially parallel to a length of the hanger. In some such examples, the back hook defines a second aperture for receiving the wall hook. In such examples, the second aperture is disposed substantially perpendicular to the first aperture.

In some examples, the rod hooks are spaced apart and parallel to each other to create multiple points of contact with the rod to prevent twisting of the hanger while hanging from the rod. In some examples, to facilitate the rod hooks in remaining coupled to the rod, each of the rod hooks includes an indentation that is configured to clamp the corresponding one of the rod hooks onto the rod. In such examples, the rod hooks are formed of semi-flexible material that enables the indentation of each of the rod hooks to flex outward to receive the rod and return inward upon receiving the rod to retain the rod.

In some examples, the back hook is coupled to the rod hooks via at least one of welding, fasteners, and adhesive. Some examples further include standoffs that include a first standoff extending from the first rod hook and a second standoff extending from the second rod hook. In such examples, the standoffs are configured to engage a wall when the back hook is hanging from the wall hook to prevent the hanger from twisting and to push a garment hanging from the arms away from the wall.

In some examples, each of the arms includes a back arm segment and a front arm segment spaced apart from the back arm segment by a slit. In such examples, a middle segment extends between and connects the front arm segment of the first arm and the front arm segment of the second arm. In some examples, the base includes a first base portion and a second base portion. In such examples, the first base portion connects the first rod hook and a first of the arms, and the second base portion connects the second rod hook and a second of the arms. In some examples, the rod hooks, the arms, and the base are integrally formed.

Another example disclosed hanger includes hooks configured to hang from an object and arms including a first arm and a second arm. Each of the arms includes a back arm segment and a front arm segment spaced apart from the back arm segment by a slit. A middle segment extends between and connects the front arm segment of the first arm and the front arm segment of the second arm. The example disclosed hanger also includes a base including a first base portion and a second base portion. The first base portion connects the first arm and one of the hooks, and the second base portion connects the second arm and one of the hooks. The arms, the middle segment, and the base are integrally formed.

In some examples, each of the arms includes a curved end extending between and connecting the front arm segment and the back arm segment.

In some examples, the front arm segment, the back arm segment, and the slit of each of the arms defines an arm width to space apart a front side and a back side of a garment hanging from the arms to deter the front side and the back side from clinging together. In some examples, to facilitate steam in flowing through a portion of a garment hanging over the arms, the slit defined by each of the arms reduces a surface area along which a hanging garment contacts the arms. In some examples, to deter the arms from sagging when a garment is hanging from the arms, the base is positioned relative to the arms to provide structural support to the arms.

Some examples further include clips that are configured to couple to the base portion and clasp at least one of pants and a skirt to hang the at least one of the pants and the skirt from the base.

In some examples, the hooks include at least one of rod hooks that are configured to hang from a rod and a back hook that is configured to hang from a wall hook.

Another example disclosed hanger includes hooks that include rod hooks for hanging from a rod. The rod hooks include a first rod hook and a second rod hook that are spaced apart from and parallel to each other. The hooks also include a back hook for hanging from a wall hook. The back hook is coupled to the first rod hook and the second rod hook. The example disclosed hanger also includes arms including a first arm and a second arm. Each of the arms includes a back arm segment and a front arm segment spaced apart from the back arm segment by a slit. A middle segment extends between and connects the front arm segment of the first arm and the front arm segment of the second arm. Each of the arms also includes a curved end extending between and connecting the front arm segment and the back arm segment. The example disclosed hanger also includes a base that includes a first base portion and a second base portion. The first base portion connects the first rod hook and the first arm. The second base portion connects the second rod hook and the second arm. The rod hooks, the arms, the middle segment, and the base are integrally formed.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
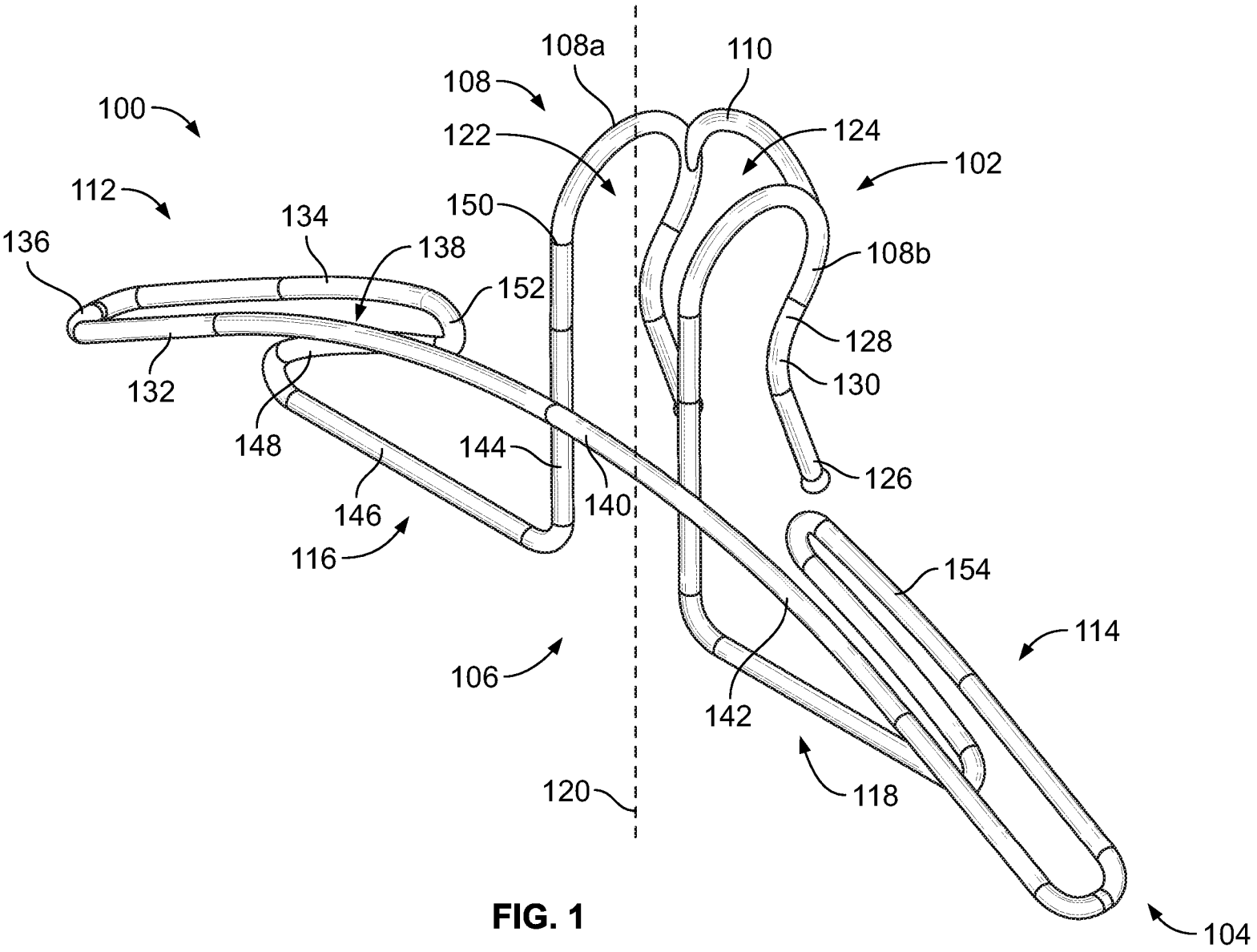
FIG. 1 is a perspective view of an example hanger in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Typically, steamers (e.g., clothes steamers, garment steamers) are utilized to steam garments and/or other fabrics. Oftentimes, a user utilizes a steamer to remove and/or reduce wrinkles of a garment without ironing the garment. Steamers remove and/or reduce wrinkles of a garment by emitting high temperature steam onto and/or through the garment that relaxes fibers of the garment. For example, a steamer may be utilized to remove wrinkles from delicate fabrics (e.g., silk) without scorching the delicate fabrics. Oftentimes, a garment and/or other fabric is hung from a hanger to enable a user to steam the garment and/or other fabric via a steamer. In some instances, the hanger from which the garment and/or other fabric twists, thereby potentially making it difficult for a user to steam garment and/or other fabric via a steamer. Further, in some instances, layers of the garment and/or other fabric contact each other while hanging from the hanger, thereby increasing a thickness through which the steam is to travel and potentially increasing an amount of time needed to remove wrinkles via steaming.

Example multi-hook hangers disclosed herein include rod hooks for hanging from a rod (e.g., a shower rod, a closet rod, etc.) and a back hook for hanging from a wall hook (e.g., connected to a wall, a door, a coat rack, etc.). The rod hooks include a first rod hook and a second rod hook that are spaced apart from and parallel to each other. The back hook extends between and is coupled to the first rod hook and the second rod hook. Additionally, the example hangers include a first arm (e.g., a left arm) and a second arm (e.g., a right arm) from which a garment and/or other fabric is to hang. Each of the arms include a back arm segment, a front arm segment spaced apart from the back arm segment by a slit, and a curved end extending between and connecting the front arm segment and the back arm segment. Further, a middle segment extends between and connects the front arm segment of the first arm and the front arm segment of the second arm to form a front portion of the hanger. The example hangers also include a base that includes a first base portion (e.g., a left base portion) and a second base portion (e.g., a right base portion). The first base portion connects the first rod hook and the first arm, and the second base portion connects the second rod hook and the second arm. Additionally, the rod hooks, the arms, the middle segment, and the base are integrally formed from a rod, and the back hook is coupled to the rod at the rod hooks.

Turning to the figures, FIG. 1 illustrates an example hanger 100 in accordance with the teachings herein. The hanger 100 is symmetrical to enable the hanger 100 to hang evenly from an object (e.g., a rod 202 of FIG. 2, a wall hook 302 of FIG. 3). For example, the hanger 100 of FIG. 1 includes a right half that is a mirror image of a corresponding left half.

As illustrated in FIG. 1, the hanger 100 includes hooks 102 for hanging from an object, arms 104 from which a garment (e.g., a shirt, a blouse, a sweater, etc.) and/or other fabric is to hang, and a base 106 to provide structural support to the arms 104. In the illustrated example, the hooks 102 include rod hooks 108 and a back hook 110. The arms 104 include a first arm 112 (e.g., a left arm) and a second arm 114 (e.g., a right arm) opposite the first arm 112. Further, the base 106 includes a first base portion 116 (e.g., a left base portion) that provides structural support to the first arm 112 and a second base portion 118 (e.g., a right base portion) opposite the first base portion 116 that provides structural support to the second arm 114.

The rod hooks 108 include a rod hook 108*a* (e.g., a first rod hook, a left rod hook) and a rod hook 108*b* (e.g., a second rod hook, a right rod hook). The rod hooks 108 are near and evenly spaced apart from a center axis 120 of the hanger 100 to enable the hanger 100 to hang evenly. The rod hooks 108 are parallel to each other and define an aperture 122 (e.g., a first aperture) through which a rod (e.g., the rod 202 of FIG. 2) is to extend when the hanger 100 hangs from the rod. That is, the rod hooks 108 define the aperture 122 for receiving the rod. In the illustrated example, a central axis of the aperture 122 is perpendicular to the center axis 120 and extends in a direction substantially parallel to a length (e.g., a length 502 of FIG. 5) of the hanger 100. The rod hooks 108 are configured to prevent the hanger 100 from twisting when hanging from a rod, thereby facilitating a user in steaming a garment and/or other fabric hanging from the hanger 100 when the hanger 100 is hanging from the rod. For example, a shape and/or a thickness of each of the rod hooks 108 enables each of the rod hooks 108 to deter twisting of the hanger 100. Additionally or alternatively, the rod hooks 108 are spaced apart from each other to create multiple points of contact along a length of the rod to further deter twisting of the hanger 100 when hanging from the rod.

The back hook 110 extends between and couples to the rod hooks 108. For example, the back hook 110 is welded and/or otherwise fastened (e.g., via, fastener(s), adhesive, etc.) to each of the rod hooks 108. The back hook 110 defines an aperture 124 (e.g., a second aperture) that is substantially perpendicular to the center axis in a different direction relative to that of the aperture 122 defined by the rod hooks 108. Further, the aperture 124 extends in a direction that is disposed substantially perpendicular to the direction of the aperture 122 and the length of the hanger 100. When hanger 100 hangs from a wall hook (e.g., the wall hook 302 of FIG. 3), the wall hook extends through the aperture 122 and engages back hook 110. For example, the aperture 124 extends in the direction that is disposed substantially perpendicular to the direction of the aperture 122 to prevent the hanger 100 from twisting when hanging from the wall hook.

As illustrated in FIG. 1, standoffs 126 extend from a first end 128 of the rod hooks 108. For example, one of the standoffs 126 extend from the rod hook 108*a*, and another of the standoffs 126 extend from the rod hook 108*b*. When the hanger 100 is hanging from a wall hook via the back hook 110, the standoffs 126 protrude in a direction away from the aperture 122 defined by the rod hooks 108 to push a garment hanging from the arms 104 away from a corresponding wall and, thus, prevent the garment hanging from contacting the wall. Further, the standoffs 126 are configured, to engage the wall to stabilize the hanger 100 against the wall when the hanger 100 is hanging from the wall hook. In turn, the standoffs 126 are configured to prevent the hanger 100 from twisting when hanging from a wall hook, thereby facilitating the user in steaming a garment hanging from the hanger 100 when the hanger 100 is hanging from the wall hook. Additionally, an indentation 130 is formed between each of the standoffs 126 and the first end 128 of the corresponding one of the rod hooks 108 to facilitate the rod hooks 108 in remaining coupled to a rod. That is, the indentations 130 are configured to clamp the rod hooks 108 onto the rod. Further, the hanger 100 is composed of semi-flexible material that enable the indentation 130 of each of the rod hooks 108 to (i) flex outward to receive a rod in the aperture 122 and (ii) return inward upon receiving the rod to retain the rod, in the aperture 122.

In the illustrated example, each of the arms 104 include a front arm segment 132, a back arm segment 134, and a curved end 136 that extends between and connects the front arm segment 132 and the back arm segment 134. The front arm segment 132 is positioned in front of the back arm segment 134 relative to the hooks 102 of the hanger 100. Further, the front arm segment 132 is spaced apart from and is parallel to the back arm segment 134 such that a slit 138 is defined between the front arm segment 132 and the back arm segment 134. The front arm segment 132, the back arm segment 134, and the slit 138 define a width (e.g., a width 408 of FIG. 4) that facilitates steaming of a garment hanging from the hanger 100. Each of the arms 104 has the width 408 to space apart a front side and a back side of a garment hanging from the hanger 100 and, thus, deter the front side and the back side of the garment from clinging together. In turn, steam is able to flow through the garment, thereby reducing an amount of time needed to remove wrinkles from the garment via steaming. Additionally or alternatively, each of the arms 104 defines the slit 138 to further facilitate steam in flowing through a portion of the garment that hangs over the arms 104 by reducing a surface area of the garment that contacts the hanger 100.

As illustrated in FIG. 1, the hanger 100 includes a middle segment 140 that extends between and connects the front arm segment 132 of the first arm 112 and the front arm segment 132 of the second arm 114. The middle segment 140 and the front arm segment 132 of each of the arms 104 defines a front portion 142 of the hanger 100. In the illustrated example, the first arm 112, the second arm 114, and the middle segment 140 define an arched profile to prevent a garment hanging from the hanger 100 from being stretched. Alternatively, the first arm 112, the second arm 114, and the middle segment 140 may define another profile that deters a garment from being stretched.

The base 106 of the illustrated example provides structural support to the arms 104 to deter the arms 104 from sagging and/or bending downward when a garment is hanging from the arms 104 of the hanger 100. For example, the base 106 is positioned relative to the arms 104 to provide the structural support to the arms 104. Further, the base 106 includes a location to which clips (e.g., clips 204 of FIG. 2) connect that enable pants and/or a skirt to hang from the base 106 of the hanger 100. As illustrated in FIG. 1, each of the first base portion 116 and the second base portion 118 include a vertical portion 144, a horizontal portion 146, and an angled portion 148. For example, the vertical portion 144 of the first base portion 116 couples to and extends downward from a second end 150 of the rod hook 108*a*, the horizontal portion 146 couples to the vertical portion 144 and extends horizontally toward the curved end 136 of the first arm 112, and the angled portion 148 couples to and extends between (at an angle) the horizontal portion 146 and the back arm segment 134 of the first arm 112 (e.g., the angled portion 148 connects to an end 152 of the back arm segment 134 that is opposite the curved end 136). Similarly, the vertical portion 144 of the second base portion 118 couples to and extends downward from the second end 150 of the rod hook 108*b*, the horizontal portion 146 couples to the vertical portion 144 and extends horizontally toward the curved end 136 of the second arm 114, and the angled portion 148 couples to and extends between (at an angle) the horizontal portion 146 and the back arm segment 134 of the second arm 114. Further, in the illustrated example, the first base portion 116, the second base portion, and the back arm segment 134 of each of the arms 104 extend along a shared, flat plane.

In the illustrated example, the rod hooks 108 (e.g., the rod hook 108*a*, the rod hook 108*b*), the standoffs 126 (e.g., the standoffs 126 extending from the rod hook 108*a* and the rod hook 108*b*), the base 106 (e.g., the first base portion 116, the second base portion), and the arms 104 (e.g., the first arm 112, the second arm 114) are integrally formed from a rod 154. For example, the rod 154 includes metallic and/or plastic material that is bent and/or curved into the shape of the hanger 100. Additionally, the back hook 110 is coupled to the rod 154 at the rod hooks 108 via welding, fastener(s), adhesive(s), etc. In other examples, the back hook 110 may be integrally formed with the rod 154 such that the hanger 100 is integrally formed from a single piece of material.

Figure 2:
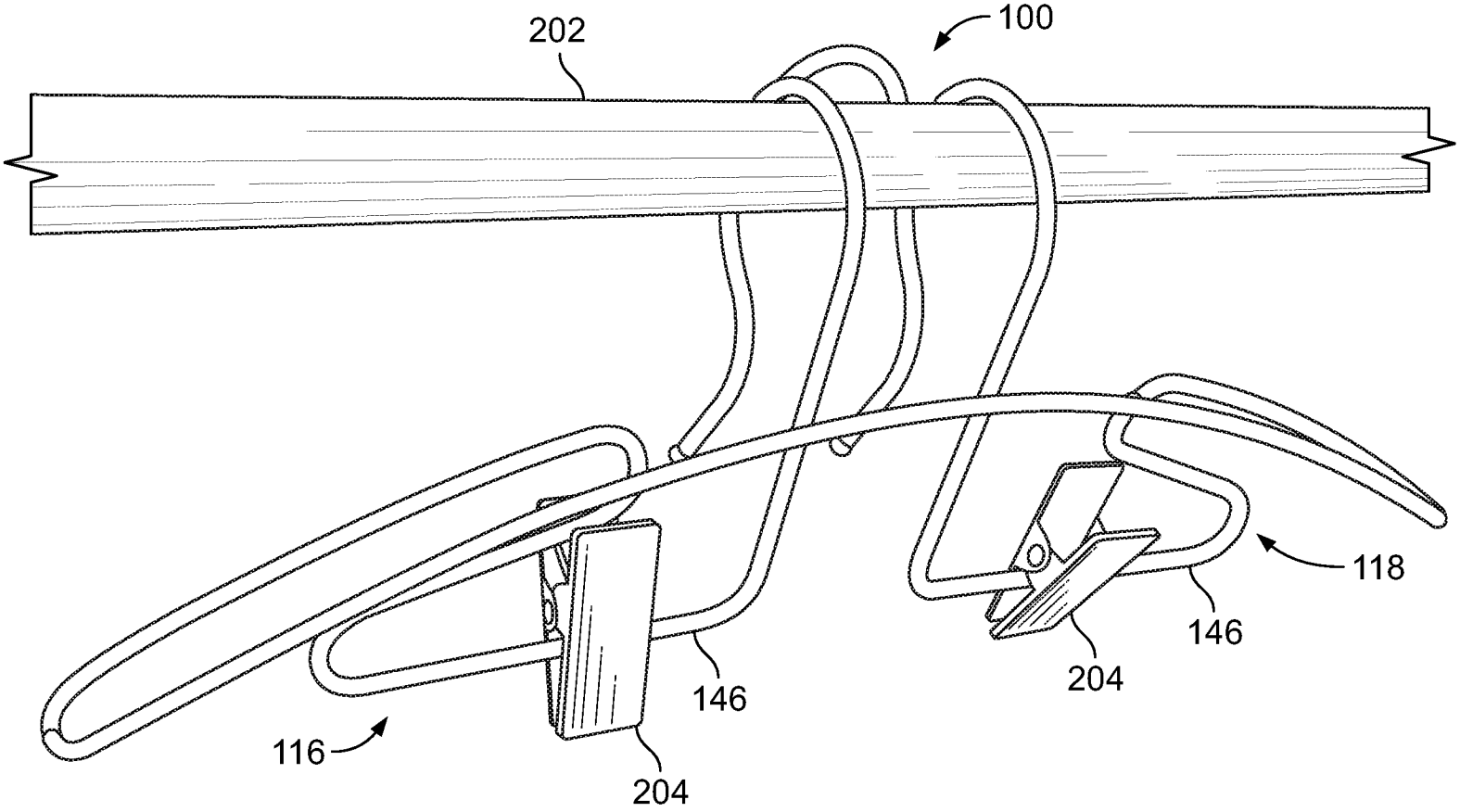
FIG. 2 illustrates the hanger of FIG. 1 hanging from a rod.

FIG. 2 illustrates the hanger 100 hanging from a rod 202 (e.g., a shower rod, a closet rod, etc.). More specifically, the hanger 100 is hanging from the rod 202 via the rod hooks 108. In the illustrated example, clips 204 are clamped onto the horizontal portion 146 of each of the first base portion 116 and the second base portion 118. The clips 204 are configured to clasp pants, skirts, and/or other garments to enable the hanger 100 to retain the pants, skirts, and/or other garments for steaming.

Figure 3:
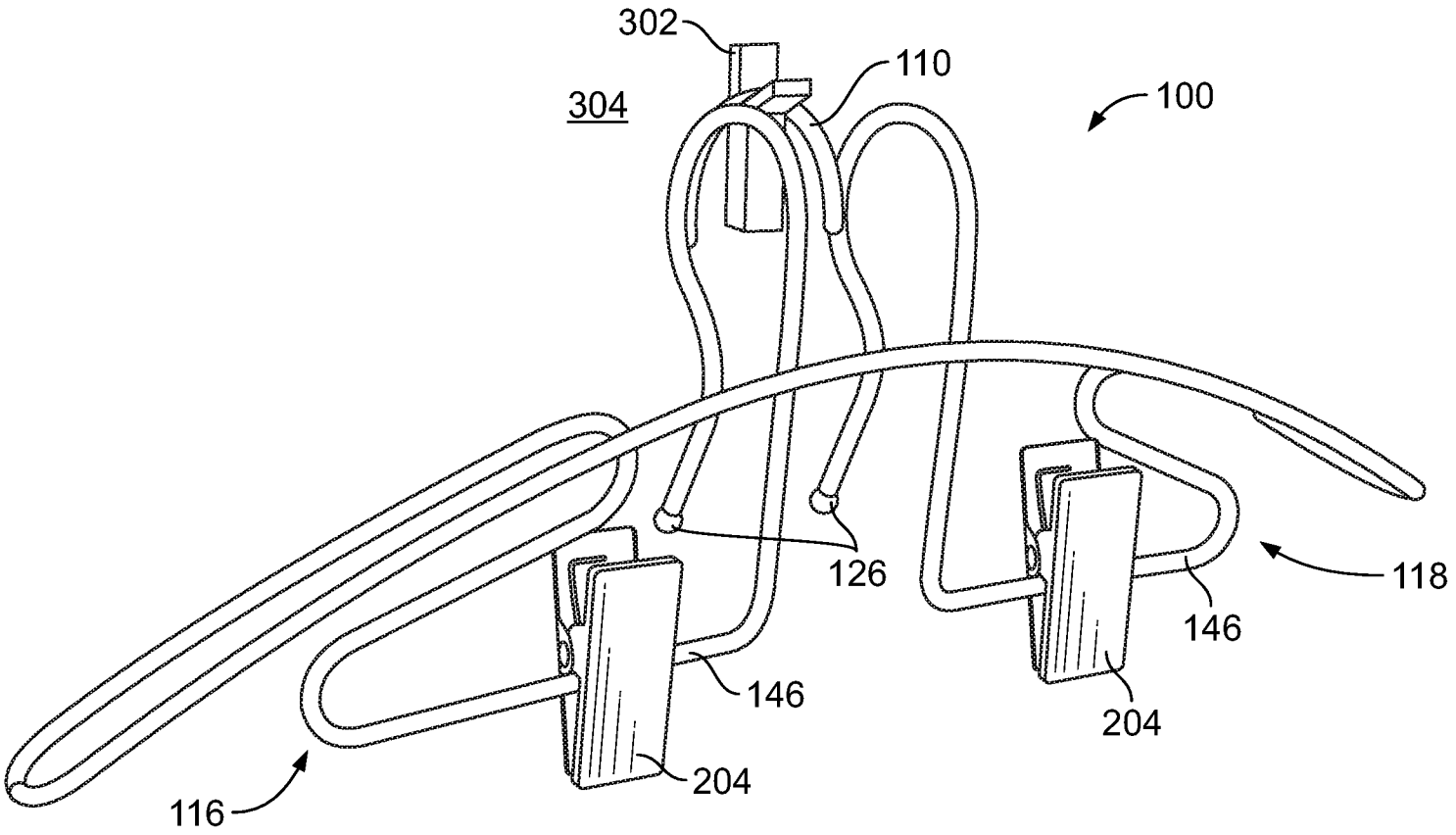
FIG. 3 illustrates the hanger of FIG. 1 hanging from a wall hook.

FIG. 3 illustrates the hanger of FIG. 1 hanging from a wall hook 302. More specifically, the hanger 100 is hanging from the wall hook 302 coupled to a surface 304 via the back hook 110. The surface 304 may be a surface of a wall, a door, a coat rack, etc. In the illustrated example, the standoffs 126 engage the surface 304 to push a garment hanging from the hanger 100 away from the surface 304 and, thus, deter the garment from contacting the surface 304. Further, the clips 204 are clamped onto the horizontal portion 146 of each of the first base portion 116 and the second base portion 118 for facilitating the hanger 100 in retaining a garment.

Figure 4:
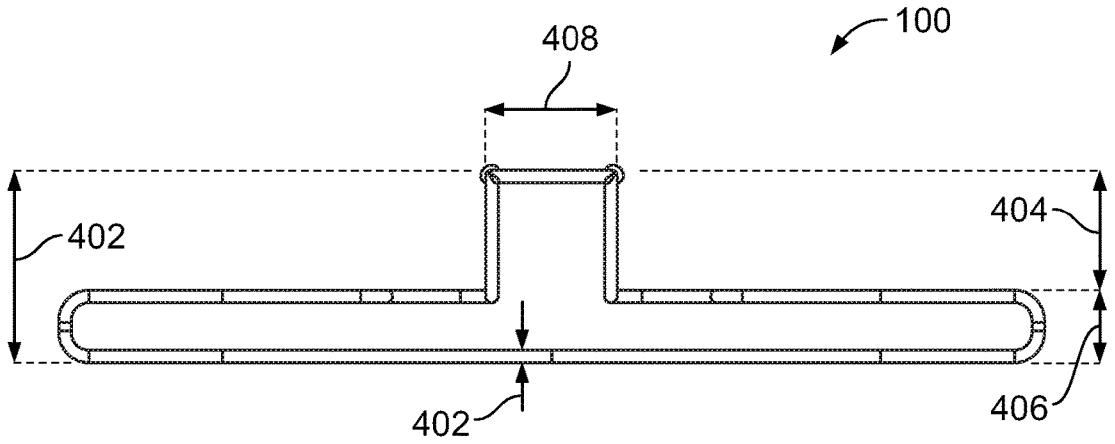
FIG. 4 is a top view of the hanger of FIG. 1.
Figure 5:
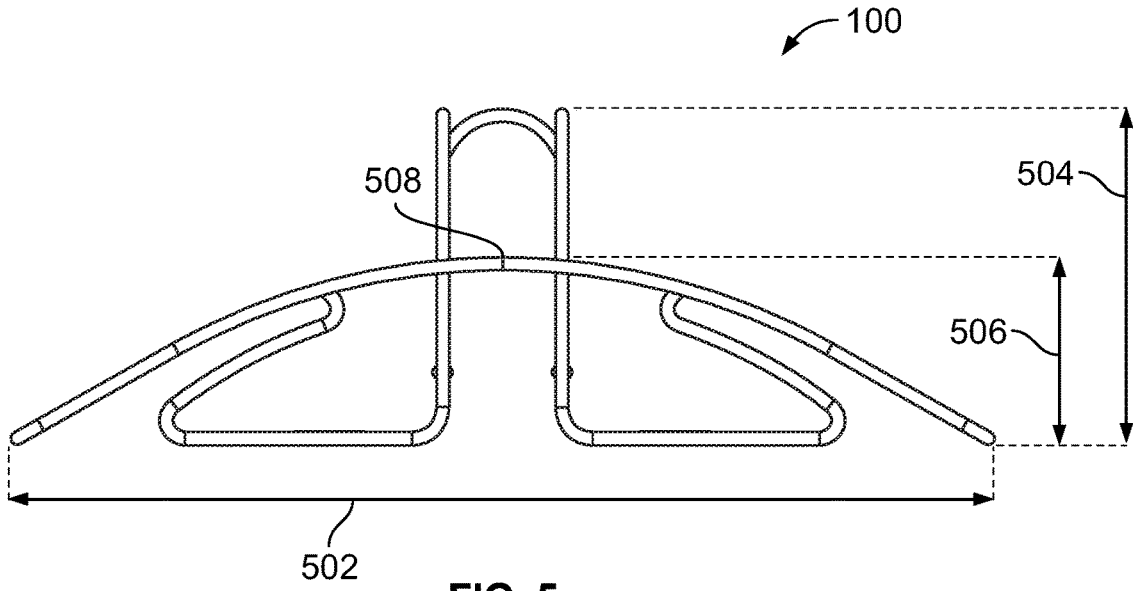
FIG. 5 is a front view of the hanger of FIG. 1.
Figure 7:
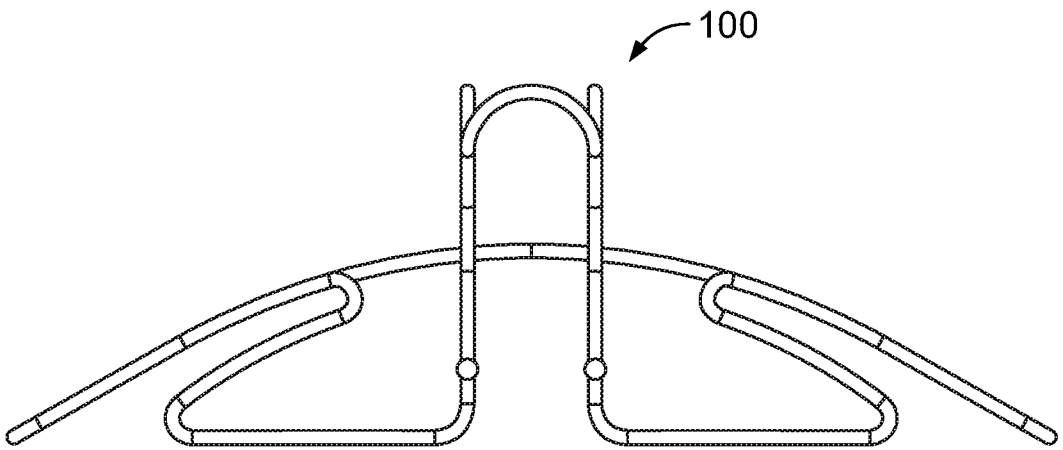
FIG. 7 is a rear view of the hanger of FIG. 1.
Figure 6:
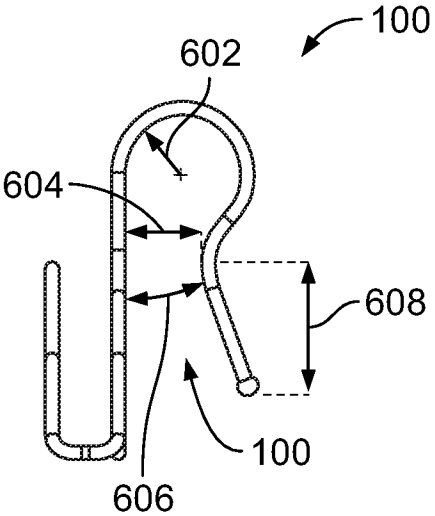
FIG. 6 is a side view of the hanger of FIG. 1.

FIG. 4-7 further depict the hanger 100. More specifically, FIG. 4 is a top view of the hanger 100, FIG. 5 is a front view of the hanger 100, FIG. 6 is a side view of the hanger 100, and FIG. 7 is a rear view of the hanger 100.

As illustrated in FIG. 4, the back hook 110 of the hanger 100 is substantially perpendicular to the rod hooks 108. Further, the rod hooks 108 are substantially perpendicular to the back arm segment 134 and the front arm segment 132 of each of the arms 104, and the back hook 110 is substantially parallel to the back arm segment 134 and the front arm segment 132 of each of the arms 104.

The rod 154 from which the rod hooks 108, the base 106, the arms 104, and the middle segment 140 are formed has a diameter 402. In the illustrated example, the diameter 402 of the rod 154 is about 0.20 inches (0.51 centimeters). Further, the hanger 100 also has a depth 404 that extends from the back hook 110 to the front portion 142 of the hanger 100. In the illustrated example, the depth 404 of the hanger 100 is about 3.20 inches (8.13 centimeters). Additionally, the rod hooks 108 have a width 406 that enables the rod hooks 108 to receive and hang from the rod 202. The back hook 110 is coupled to the rod hooks 108 such that the back hook 110 is spaced apart from the arms 104 by the width 406 of the rod hooks 108. In the illustrated example, the width 406 of each of the rod hooks 108 is about 2.20 inches (5.59 centimeters). Also, the front arm segment 132 and the back arm segment 134 of each of the arms 104 are spaced apart from each other by the slit 138 such that each of the arms 104 has a width 408. In the illustrated example, the width 408 of each of the arms 104 is about 1.20 inches (3.05 centimeters).

The width 408 of the arms 104 deters a garment hanging from the arms 104 from clinging to itself by spacing apart a front side and a back side of the garment. In turn, the width 408 of the arms 104 facilitates steam in flowing through the garment and, thus, facilitates in removing wrinkles from the garment. Also, the slit 138 of each of the arms 104 further facilitates steam in flowing through a portion of the garment that rests above the arms 104 of the hanger 100 by reducing a surface area of the garment that contacts the hanger 100 while hanging from the hanger 100.

Further, the back hook 110 has a width 410 that enables the back hook 110 to receive and hang from the wall hook 302. The back hook 110 is coupled to the rod hooks 108 such that the rod hooks 108 are spaced apart from each other by the width 410 of the back hook 110. In the illustrated example, the width 410 of the back hook 110 is about 2.00 inches (5.08 centimeters).

As illustrated in FIG. 5, the hanger 100 has a length 502 that extends from the curved end 136 of the first arm 112 to the curved end 136 of the second arm 114. In the illustrated example, the length 502 of the hanger 100 is about 16.20 inches (41.15 centimeters). Additionally, the hanger 100 has a height 504 that extends from the rod hooks 108 and/or the back hook 110 to the curved end 136 of one or more of the arms 104, the horizontal portion 146 of the first base portion 116, and/or the horizontal segment of the second base portion 118. In the illustrated example, the height 504 of the hanger 100 is about 5.50 inches (13.98 centimeters).

Further the front portion 142 from which a garment is to hang has a height 506 that extends from the curved end 136 of each of the arms 104 to an apex 508 of the middle segment 140. For example, the front portion 142, as well as the back arm segment 134 of each of the arms 104, is arched upward to deter a garment from being stretched while hanging from the hanger 100. In the illustrated example, the height of the front portion 142 is about 2.98 inches (7.56 centimeters).

As illustrated in FIG. 6, each of the rod hooks 108 has a radius 602 that enables the rod hooks 108 to hang from the rod 202. In the illustrated example, the radius 602 of each of the rod hooks 108 is about 0.90 inches (2.29 centimeters). Additionally, an opening 604 to the aperture 122 of the rod hooks 108 is less than a diameter of the rod hooks 108. The opening 604 is defined by the second end 150 of the rod hooks 108 and the indentation 130. In the illustrated example, the opening 604 is about 1.20 inches (3.05 centimeters). The rod hooks 108 flex outward to enable the rod 202 to be positioned through the aperture 122 of the rod hooks 108 and flex inward to retain the rod 202 in the aperture 122. Further, the standoff's 126 extend downward at an angle 606 by a distance 608 to enable the standoffs 126 to engage the surface 304 when the hanger 100 is hanging from the wall hook 302. In the illustrated example, the angle 606 at which the standoffs 126 extend relative to vertical portion 144 of the base 106 is about 19.6 degrees, and the distance 608 that the standoffs 126 extends downward is about 1.86 inches (4.71 centimeters)

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A hanger comprising:

rod hooks configured to hang from a rod, the rod hooks include a first rod hook and a second rod hook that are spaced apart from and parallel to each other;

a back hook configured to hang from a wall hook, the back hook being coupled to the first rod hook and the second rod hook;

arms configured to hang a garment;

a base that connects the arms to the rod hooks and provides structural support to the arms; and standoffs that include a first standoff extending from the first rod hook and a second standoff extending from the second rod hook, the standoffs being configured to engage a wall when the back hook is hanging from the wall hook to prevent the hanger from twisting and to push a garment hanging from the arms away from the wall.

2. The hanger of claim 1, wherein the rod hooks define a first aperture for receiving the rod.

3. The hanger of claim 2, wherein a central axis of the first aperture extends in a direction that is substantially parallel to a length of the hanger.

4. The hanger of claim 3, wherein the back hook defines a second aperture for receiving the wall hook, the second aperture being disposed substantially perpendicular to the first aperture.

5. The hanger of claim 1, wherein the rod hooks are spaced apart and parallel to each other to create multiple points of contact with the rod to prevent twisting of the hanger while hanging from the rod.

6. The hanger of claim 1, wherein, to facilitate the rod hooks in remaining coupled to the rod, each of the rod hooks includes an indentation that is configured to clamp the corresponding one of the rod hooks onto the rod.

7. The hanger of claim 6, wherein the rod hooks are formed of semi-flexible material that enables the indentation of each of the rod hooks to flex outward to receive the rod and return inward upon receiving the rod to retain the rod.

8. The hanger of claim 1, wherein the back hook is coupled to the rod hooks via at least one of welding, fasteners, and adhesive.

9. The hanger of claim 1, wherein each of the arms includes:

a back arm segment; and a front arm segment spaced apart from the back arm segment, wherein a middle segment extends between and connects the front arm segment of the first arm and the front arm segment of the second arm.

10. The hanger of claim 1, wherein the base includes a first base portion and a second base portion, the first base portion connects the first rod hook and a first of the arms, the second base portion connects the second rod hook and a second of the arms.

11. The hanger of claim 1, wherein the rod hooks, the arms, and the base are integrally formed.

12. A hanger comprising:

hooks configured to hang from an object;

arms including a first arm and a second arm, each of the arms including:

a back arm segment; and a front arm segment spaced apart from the back arm segment by a slit, wherein a middle segment extends between and connects the front arm segment of the first arm and the front arm segment of the second arm; and a base including a first base portion and a second base portion, the first base portion connects the first arm and one of the hooks, the second base portion connects the second arm and one of the hooks, wherein the arms, the middle segment, and the base are integrally formed.

13. The hanger of claim 12, wherein each of the arms includes a curved end extending between and connecting the front arm segment and the back arm segment.

14. The hanger of claim 12, wherein the front arm segment, the back arm segment, and the slit of each of the arms defines an arm width to space apart a front side and a back side of a garment hanging from the arms to deter the front side and the back side from clinging together.

15. The hanger of claim 12, wherein, to facilitate steam in flowing through a portion of a garment hanging over the arms, the slit defined by each of the arms reduces a surface area along which a hanging garment contacts the arms.

16. The hanger of claim 12, wherein, to deter the arms from sagging when a garment is hanging from the arms, the base is positioned relative to the arms to provide structural support to the arms.

17. The hanger of claim 12, further including clips that are configured to couple to the base portion and clasp at least one of pants and a skirt to hang the at least one of the pants and the skirt from the base.

18. The hanger of claim 12, wherein the hooks include at least one of rod hooks that are configured to hang from a rod and a back hook that is configured to hang from a wall hook.

19. A hanger comprising:

hooks including:

rod hooks for hanging from a rod, the rod hooks include a first rod hook and a second rod hook that are spaced apart from and parallel to each other; and a back hook for hanging from a wall hook, the back hook is coupled to the first rod hook and the second rod hook;

arms including a first arm and a second arm, each of the arms including:

a back arm segment;

a front arm segment spaced apart from the back arm segment by a slit, wherein a middle segment extends between and connects the front arm segment of the first arm and the front arm segment of the second arm; and a curved end extending between and connecting the front arm segment and the back arm segment; and a base including a first base portion and a second base portion, the first base portion connects the first rod hook and the first arm, the second base portion connects the second rod hook and the second arm, wherein the rod hooks, the arms, the middle segment, and the base are integrally formed.

* * * * *